US011549460B2

(12) United States Patent
Sugimoto et al.

(10) Patent No.: US 11,549,460 B2
(45) Date of Patent: Jan. 10, 2023

(54) WATER COOLED ENGINE

(71) Applicant: KUBOTA Corporation, Osaka (JP)

(72) Inventors: Satoshi Sugimoto, Sakai (JP); Yusuke Komemushi, Sakai (JP); Naoki Wada, Sakai (JP)

(73) Assignee: KUBOTA CORPORATION, Naniwa-Kuosaka (JP)

( * ) Notice: Subject to any disclaimer, the term of this patent is extended or adjusted under 35 U.S.C. 154(b) by 100 days.

(21) Appl. No.: 16/859,554

(22) Filed: Apr. 27, 2020

(65) Prior Publication Data

US 2020/0256279 A1 Aug. 13, 2020

Related U.S. Application Data

(63) Continuation of application No. 15/987,980, filed on May 24, 2018, now Pat. No. 10,669,968.

(30) Foreign Application Priority Data

Jun. 30, 2017 (JP) ..... JP2017-128302

(51) Int. Cl.
*F02F 1/40* (2006.01)
*F01P 3/14* (2006.01)
(Continued)

(52) U.S. Cl.
CPC *F02F 1/40* (2013.01); *F01P 3/02* (2013.01); *F01P 3/14* (2013.01); *F01P 3/16* (2013.01);
(Continued)

(58) Field of Classification Search
CPC ..... F02F 1/10; F02F 1/14; F02F 1/38; F02F 1/40; F02F 2001/104; F01P 3/02; F01P 2003/024
(Continued)

(56) References Cited

U.S. PATENT DOCUMENTS 1,750,729 A * 3/1930 Ruegg ..... F02F 1/38 123/41.77
3,769,948 A 11/1973 Feichtinger et al.
(Continued)

FOREIGN PATENT DOCUMENTS

CN 1386964 A 12/2002
DE 2726095 A1 * 1/1978 ..... F02F 1/38
(Continued)

OTHER PUBLICATIONS

DE-4116943-C1 English machine translation provided by ESPACENET of Claims (Year: 2021).*
(Continued)

*Primary Examiner* — Michael A Kessler
(74) *Attorney, Agent, or Firm* — Panitch Schwarze Belisario & Nadel LLP

(57) ABSTRACT

There is provided a water cooled engine including a cylinder head with minimized thermal strain.
A head water jacket includes an inter-exhaust-port-wall water channel between a first exhaust entrance port wall and a second exhaust entrance port wall. A cylinder head includes a cooling water injection passage provided at a bottom wall of the cylinder head. The cooling water injection passage is positioned on the exhaust end side, and includes a passage entrance provided on the exhaust end side, and a passage exit directed toward the inter-exhaust-port-wall water channel. An exhaust port wall includes a heat dissipation fin extending from a first exhaust entrance port wall toward an exhaust end. The space between the heat dissipation fin and a second exhaust entrance port wall forms a water channel entrance of the inter-exhaust-port-wall water channel.

15 Claims, 7 Drawing Sheets

(51) Int. Cl.

| | |
|---|---|
| ***F02F 1/38*** | (2006.01) |
| ***F01P 3/16*** | (2006.01) |
| ***F02F 1/24*** | (2006.01) |
| ***F01P 3/02*** | (2006.01) |
| ***F02F 1/42*** | (2006.01) |

(52) U.S. Cl.
CPC ..... *F02F 1/242* (2013.01); *F02F 1/38* (2013.01); *F02F 1/4214* (2013.01); *F02F 1/4285* (2013.01); *F01P 2003/024* (2013.01)

(58) Field of Classification Search
USPC ..... 123/41.74, 41.82 R
See application file for complete search history.

(56) References Cited

U.S. PATENT DOCUMENTS

| | | | | | |
|---|---|---|---|---|---|
| 4,455,973 | A * | 6/1984 | Stadler | F02F 1/40 | 123/41.76 |
| 4,714,058 | A * | 12/1987 | Oda | F02F 1/40 | 123/41.32 |
| 4,781,158 | A * | 11/1988 | Bauer | F02F 1/4285 | 123/193.3 |
| 4,884,539 | A * | 12/1989 | Ciccarone | F01L 1/0532 | 123/310 |
| 4,889,080 | A | 12/1989 | Oguri | | |
| 4,957,068 | A * | 9/1990 | Wagner | F02F 1/4214 | 123/41.82 R |
| 4,993,227 | A | 2/1991 | Nagura et al. | | |
| 5,086,733 | A * | 2/1992 | Inoue | F01P 3/02 | 123/41.79 |
| 5,551,382 | A * | 9/1996 | Bauer | F01P 1/02 | 123/41.82 R |
| 5,799,627 | A * | 9/1998 | Dohn | F02F 1/40 | 123/41.82 R |
| 6,024,057 | A | 2/2000 | Betchaku | | |
| 6,412,452 | B1 * | 7/2002 | Bertsch | F02F 1/40 | 123/41.82 R |
| 2002/0170510 | A1 * | 11/2002 | Iizuka | F02B 75/20 | 123/41.84 |
| 2003/0056738 | A1 | 3/2003 | Aketa et al. | | |
| 2004/0173168 | A1 * | 9/2004 | Obermayer | F02F 1/40 | 123/41.31 |
| 2005/0145205 | A1 * | 7/2005 | Haubner | F02F 1/40 | 123/41.31 |
| 2012/0285403 | A1 * | 11/2012 | Brandl | F02F 1/40 | 123/41.31 |
| 2015/0204267 | A1 * | 7/2015 | Lazich | F02F 1/36 | 123/193.5 |
| 2016/0123271 | A1 | 5/2016 | Knollmayr et al. | | |
| 2018/0223768 | A1 | 8/2018 | Miura et al. | | |

FOREIGN PATENT DOCUMENTS

| | | | | | |
|---|---|---|---|---|---|
| DE | 4116943 | C1 * | 6/1992 | F02F 1/4214 | |
| JP | S48028834 | A | 4/1973 | | |
| JP | 05026107 | A * | 2/1993 | F02F 1/38 | |
| JP | H08-261059 | A | 10/1996 | | |
| JP | H09060555 | A | 3/1997 | | |
| JP | H11264344 | A | 9/1999 | | |
| JP | 2000220451 | A | 8/2000 | | |
| JP | 2002310000 | A | 10/2002 | | |
| JP | 2002310000 | A * | 10/2002 | F02F 1/4264 | |
| JP | 2008075503 | A | 4/2008 | | |
| JP | 2008075506 | A | 4/2008 | | |
| JP | 2008075508 | A | 4/2008 | | |
| JP | 2009243400 | A | 10/2009 | | |
| JP | 6127950 | B2 | 5/2017 | | |
| WO | 2015002810 | A1 | 1/2015 | | |

OTHER PUBLICATIONS

DE-4116943-C1 English machine translation provided by ESPACENET of Description (Year: 2021).*
JP-2002310000-A English machine translation provided by ESPACENET of Description (Year: 2021).*
JP 09060555 A English machine translation provided by ESPACENET of Description (Year: 2021).*
English machine translation of description for JP-05026107-A provided by ESPACENET (Year: 2022).*
Extended European Search Report dated Jul. 4, 2018 in EP Application No. 18170161.6.
PDF of http://web.archive.org/web/20170422180526/http://www.hks-power.co.jp/en/product/engine/gasket/index.html (2017).
Extended European Search Report Feb. 19, 2020 in European Application No. 20152095.4.
Office Action dated Sep. 18, 2019 in U.S. Appl. No. 15/987,980 by Sugimoto.
Office Action dated May 27, 2020 in Japanese Application No. 2017-128302.
Office Action dated May 27, 2020 issued in Japanese Application No. 2018-170226.
Office Action dated Mar. 23, 2021 in Chinese Application No. 201810413252.5.

* cited by examiner 6
5
6c
36
BOTTOM
6a
27b
27
TOP
27a

31
BOTTOM
32a
6c
6
2a
2b
6a
2c
32
6e
6f
6d
TOP

AIR INTAKE SIDE
EXHAUST SIDE
FRONT
REAR
6
6b
2
20
29a
29
29b
37
37a
36
38
15
3a
3d
30b
2a
2b
27
31a
31b
31
32
3b
34
30a
6e
3e
27
30
27a
3
6c
6a
B
C

WATER COOLED ENGINE

CROSS-REFERENCE TO RELATED APPLICATIONS

This application is a Continuation of U.S. patent application Ser. No. 15/987,980 filed May 24, 2018, which claims priority under 35 U.S.C. § 119(b) to Japanese Application No. 2017-128302 filed Jun. 30, 2017, the disclosures of which are incorporated herein by reference in their entirety.

BACKGROUND OF THE INVENTION

Field of the Invention

The present invention relates to a water cooled engine.

Description of Related Art

When output is increased with a conventional water cooled engine, the temperature of the exhaust gas may rise and cooling may become insufficient at the exhaust side, inviting an increase in thermal strain of the cylinder head.

SUMMARY OF THE INVENTION

An object of the present invention is to provide a water cooled engine including a cylinder head with minimized thermal strain.

The major configuration of the present invention are as follows.

A cylinder head includes a cooling water injection passage provided at a bottom wall of the cylinder head, the cooling water injection passage being positioned (biased) on an exhaust end side, and including a passage entrance provided on the exhaust end side and a passage exit directed toward an inter-exhaust-port-wall water channel.

An exhaust port wall includes a heat dissipation fin extending from a first exhaust entrance port wall toward the exhaust end, a space between the heat dissipation fin and a second exhaust entrance port wall forming a water channel entrance of the inter-exhaust-port-wall water channel.

It is desirable that a water channel exit of the inter-exhaust-port-wall water channel is directed to a fuel injector.

According to the present invention, thermal strain of the cylinder head is minimized.

According to the present invention, high cooling performance is achieved at the first exhaust entrance port wall.

According to the present invention, high cooling performance is achieved at the first exhaust entrance port wall and the second exhaust entrance port wall.

DETAILED DESCRIPTION OF PREFERRED EMBODIMENT

Figure 1B:
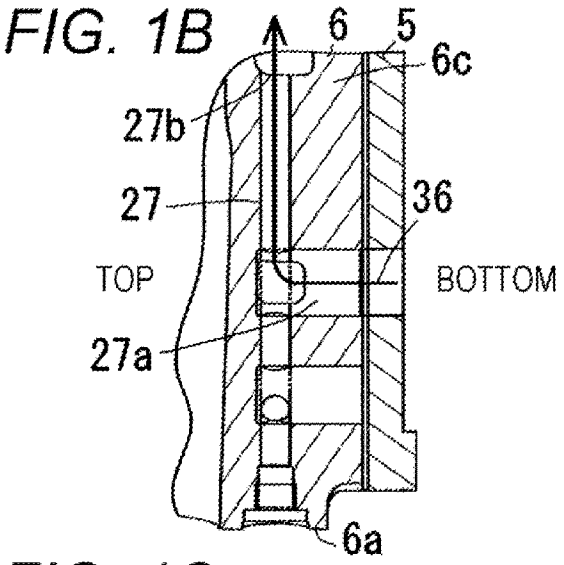
FIG. 1B is a cross-sectional view taken along line B-B in FIG. 1A.
Figure 1C:
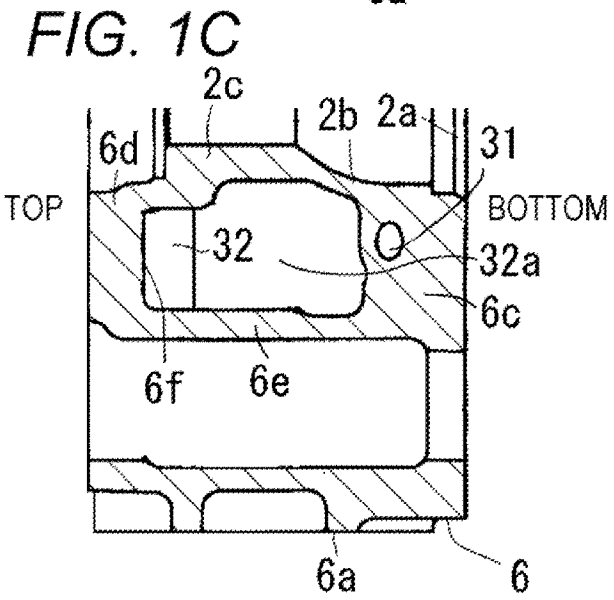
FIG. 1C is a cross-sectional view taken along line C-C in FIG. 1A.
Figure 1A:
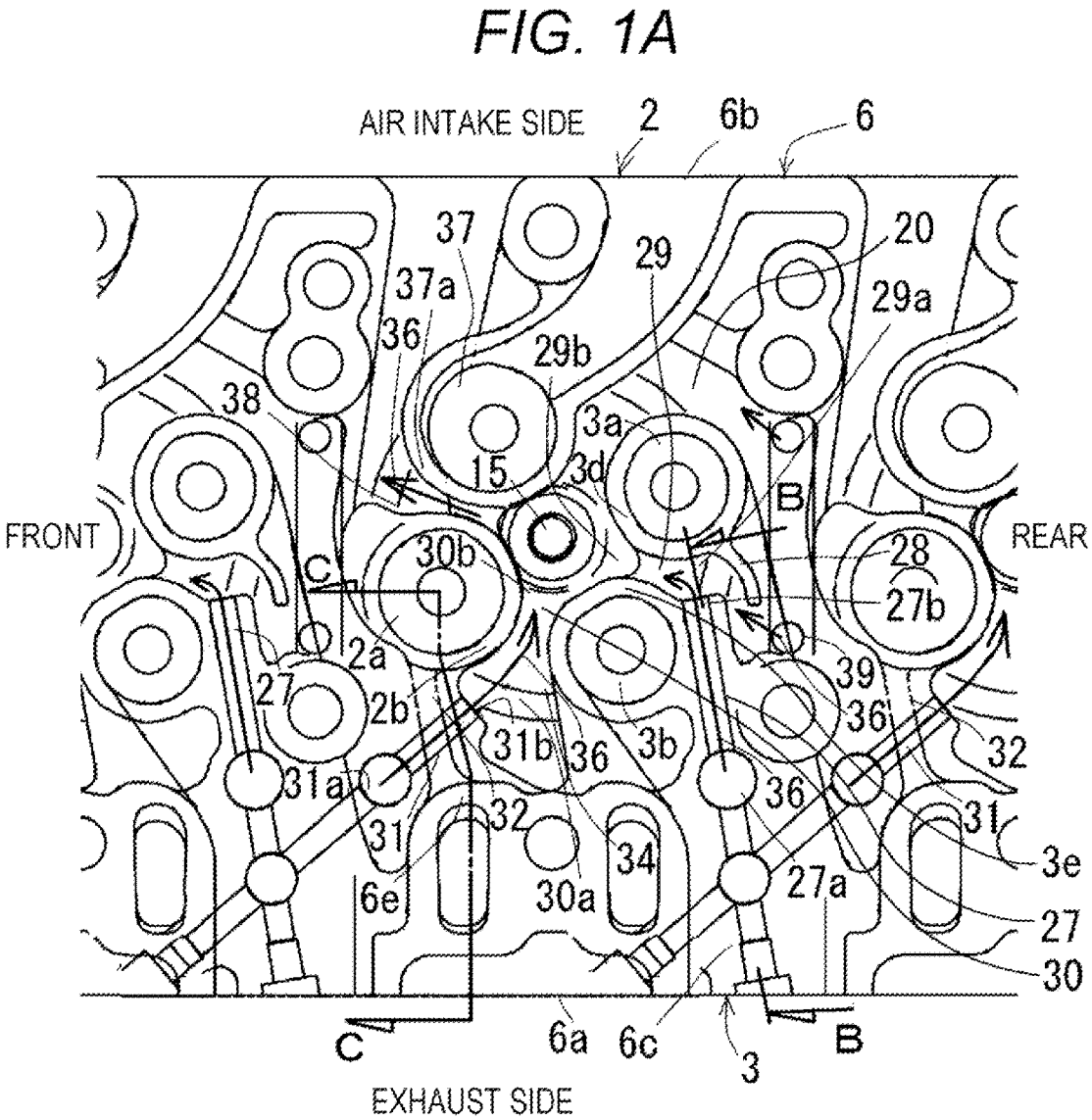
FIG. 1A is a schematic plan view describing a cylinder head of a water cooled engine according to an embodiment of the present invention.

FIGS. 1A to 1C are illustrations describing a water cooled engine according to an embodiment of the present invention. In the present embodiment, a description will be given of a water-cooled common-rail inline four-cylinder diesel engine.

The overview of the engine is as follows.

Figure 3:
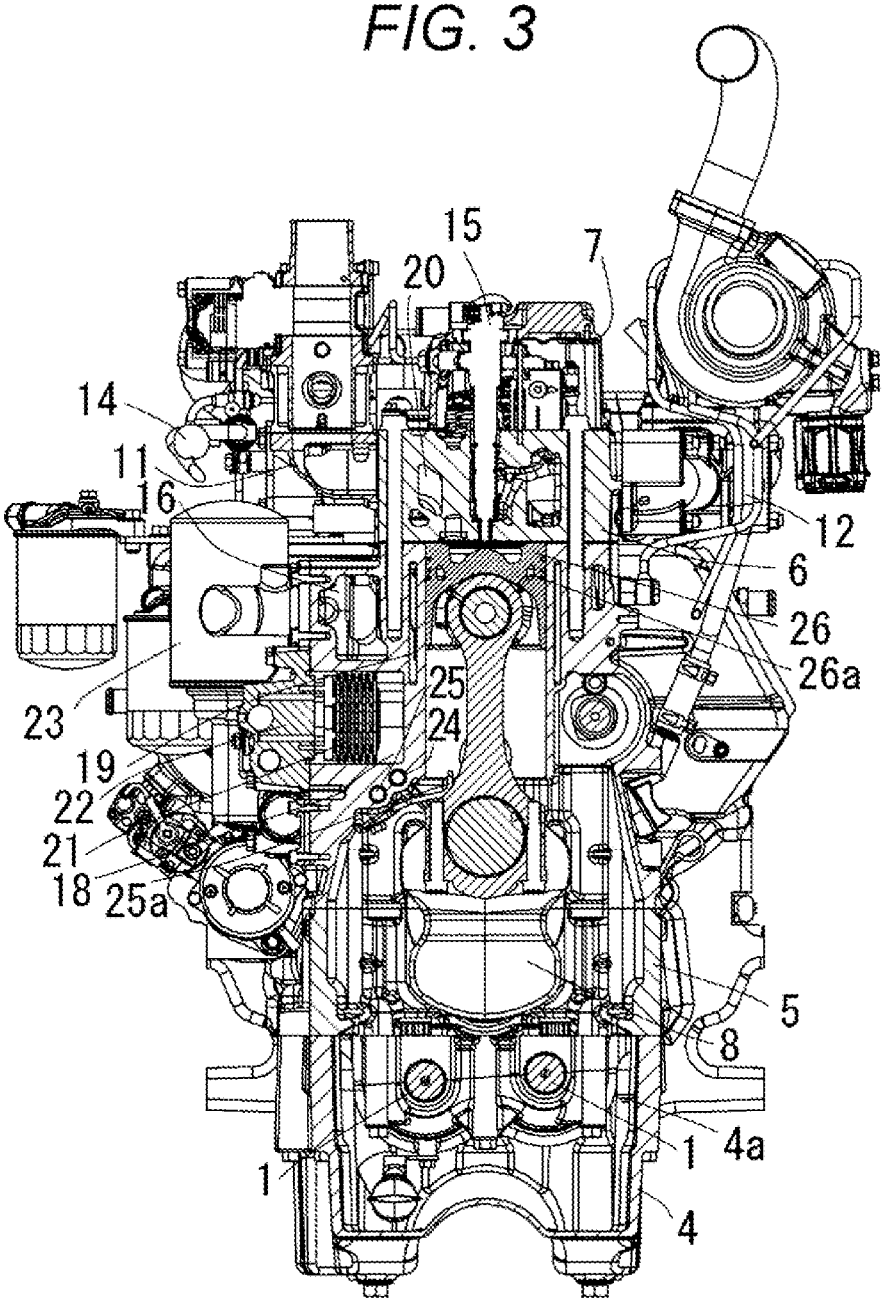
FIG. 3 is a vertical cross-sectional front view of the engine of the embodiment of the present invention.
Figure 4:
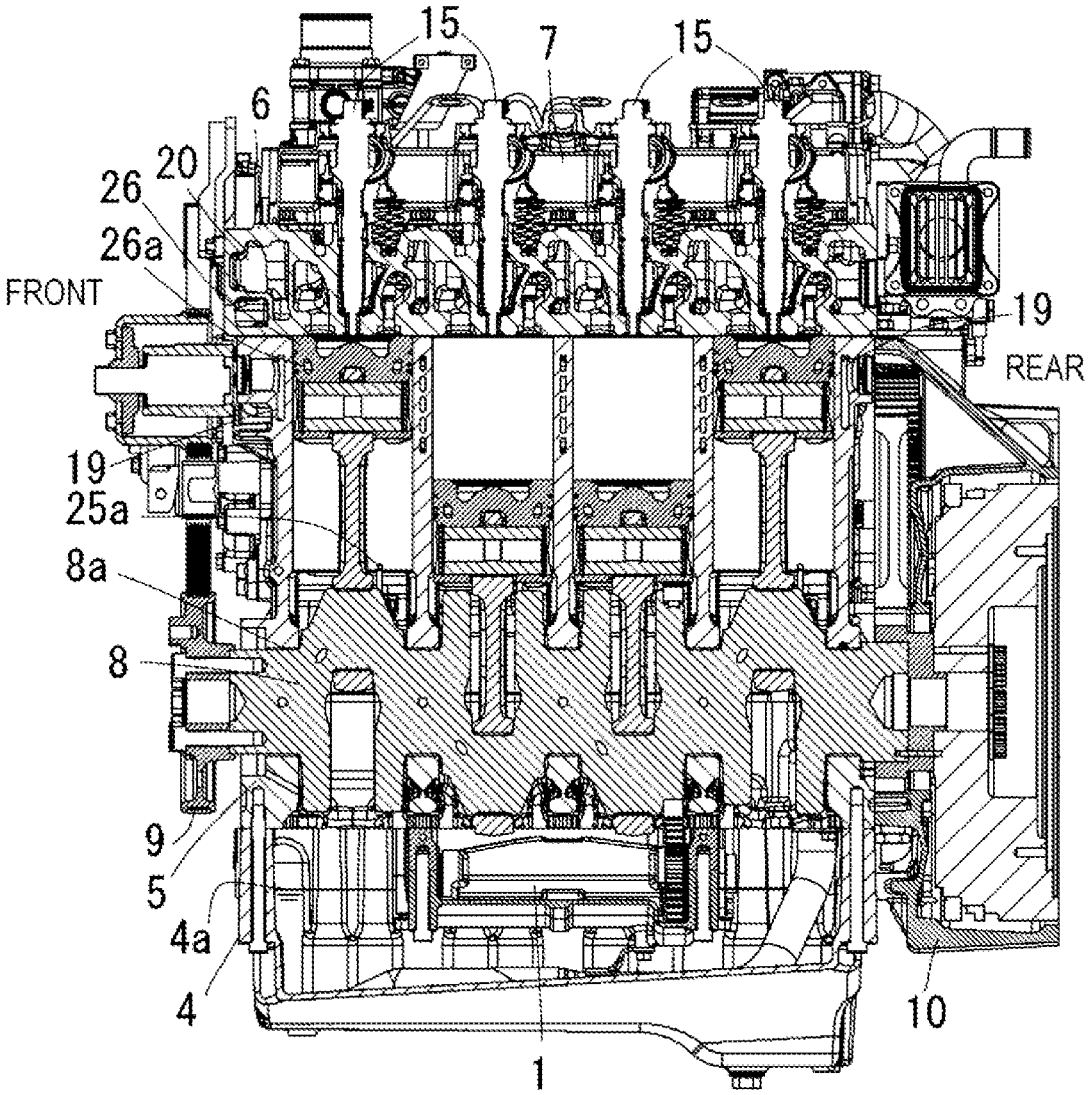
FIG. 4 is a vertical cross-sectional side view of the engine shown in FIG. 3.
Figure 5:
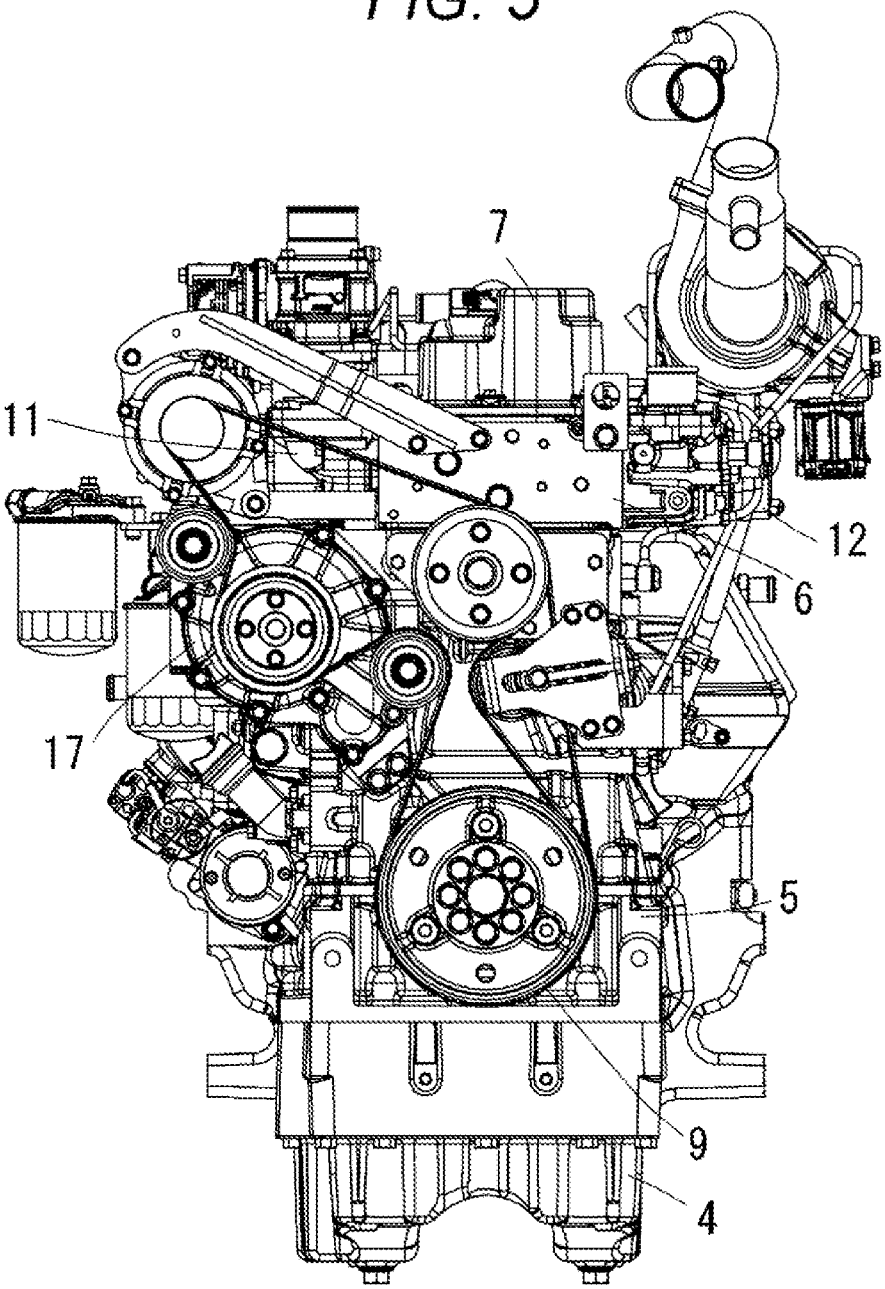
FIG. 5 is a front view of the engine shown in FIG. 3.

As shown in FIG. 3, the engine includes: a cylinder block (5); a cylinder head (6) mounted on an upper part of the cylinder block (5); a cylinder head cover (7) mounted on an upper part of the cylinder head (6); an oil pan (4) mounted on a lower part of the cylinder block (5); a belt transmission mechanism (9) disposed at a front part of the cylinder block (5) as shown in FIG. 4 where an extending direction of the crankshaft (8) is a front-rear direction; a flywheel housing (10) disposed at a rear part of the cylinder block (5); an intake manifold (11) provided on laterally one side of the cylinder head (6) as shown in FIG. 3 where a width direction of the engine being perpendicular to the front-rear direction is a lateral direction; and an exhaust manifold (12) provided on laterally other side of the cylinder head (6).

The engine includes a fuel injection apparatus, a vibration damper apparatus, a water-cooling apparatus, a lubricating apparatus, and an oil-cooling apparatus.

Figure 6:
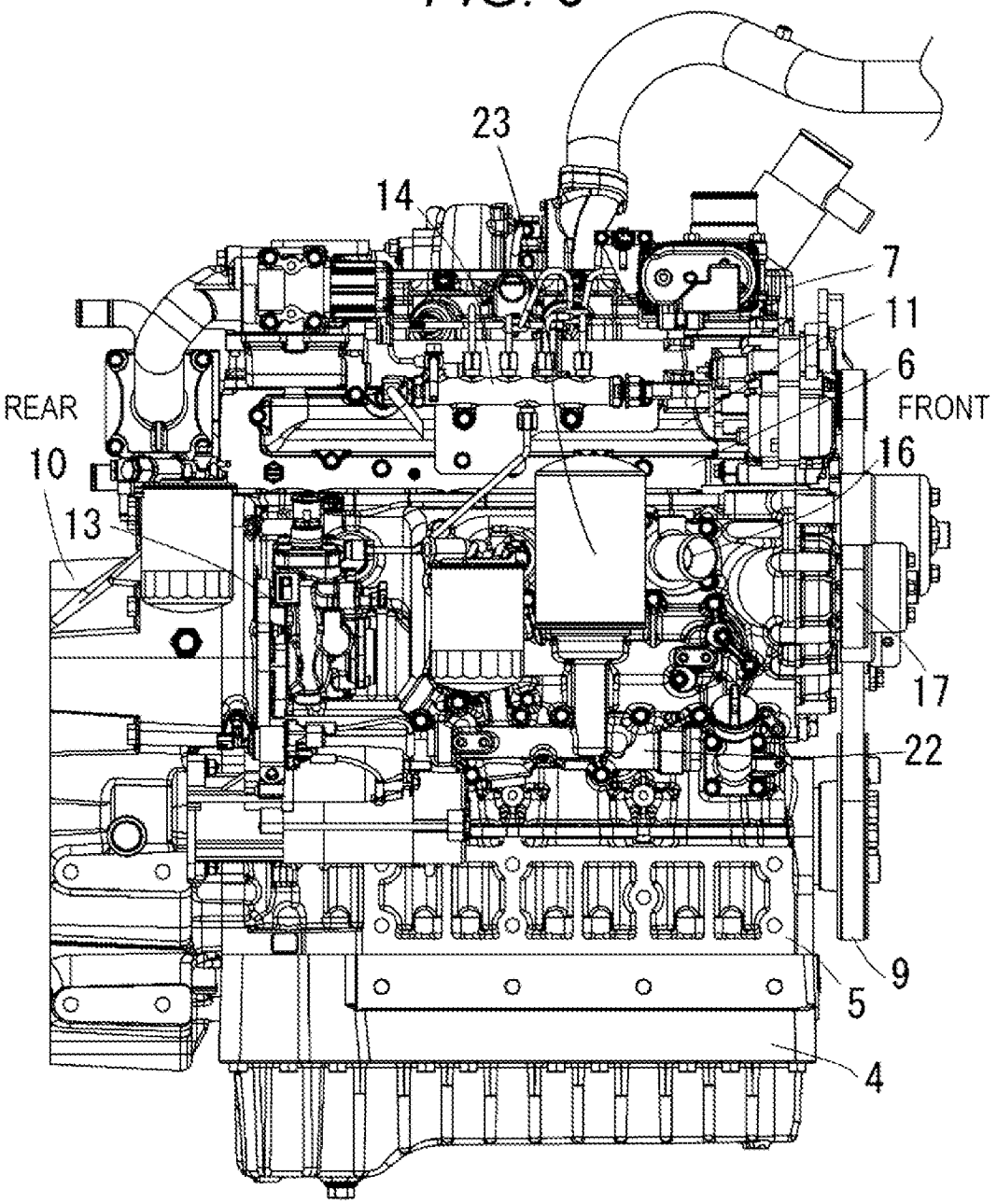
FIG. 6 is a side view of the engine shown in FIG. 3.
Figure 7:
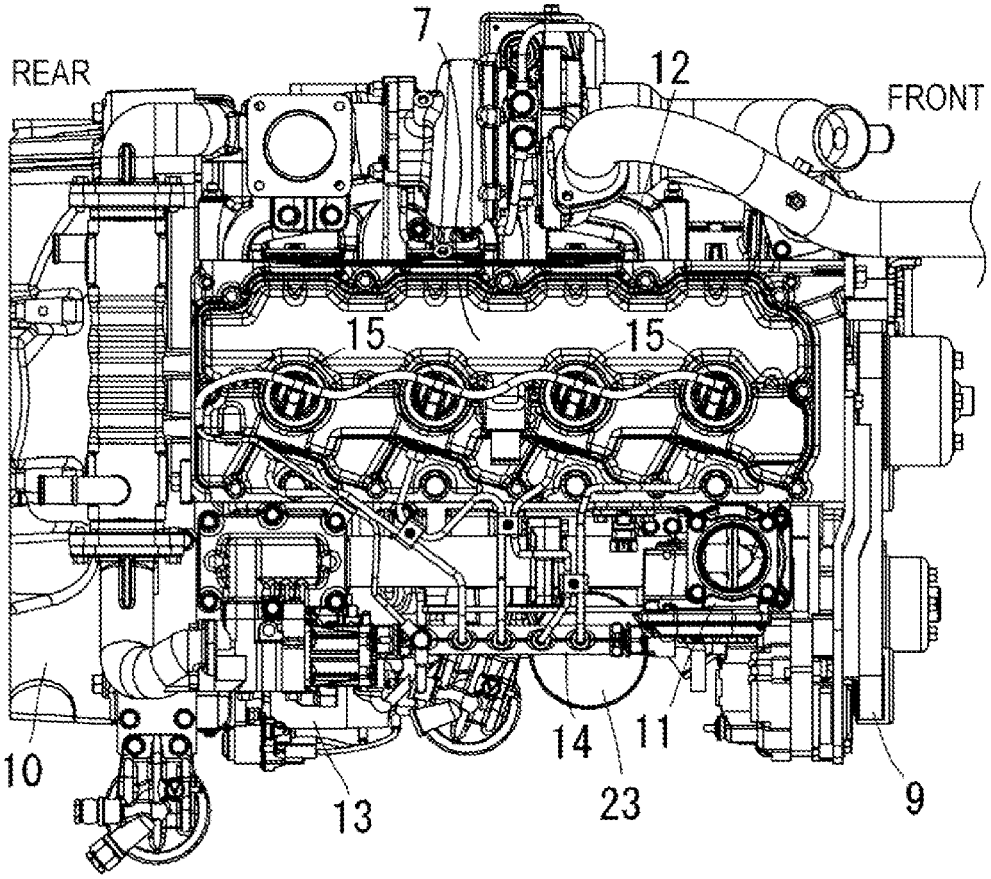
FIG. 7 is a plan view of the engine shown in FIG. 3.

The fuel injection apparatus is of the common rail type, and includes, as shown in FIG. 6, a fuel supply pump (13), a common rail (14), and a fuel injector (15) as shown in FIG. 4, to inject fuel into a combustion chamber.

As shown in FIG. 3, the vibration damper apparatus includes rotary balancers (1), to cancel out the secondary vibrations of the engine thereby reducing the vibrations of the engine.

The water-cooling apparatus includes: a radiator (not shown); a water entrance chamber (16) provided on the air intake side of the cylinder block (5) as shown in FIG. 3; a water pump (17) provided at a front part of the water entrance chamber (16) as shown in FIG. 6; and as shown in FIG. 3, a water relay chamber (18) provided on the rear side of the water pump (17) and at a lower part of the water entrance chamber (16); a block water jacket (19) provided inside the cylinder block (5); and a head water jacket (20) provided inside the cylinder head (6).

The water-cooling apparatus causes, using the pump pressure of the water pump (17), an engine cooling water having its heat dissipated by the radiator to circulate sequentially through the water entrance chamber (16), the water pump (17), the water relay chamber (18), the block water jacket (19), the head water jacket (20), and the radiator, to cool the engine.

The lubricating apparatus includes: an oil pump (not shown) built inside the rear part of the cylinder block (5); and as shown in FIG. 3, an oil cooler (21) housed in the water relay chamber (18); an oil filter (23) mounted together with the oil cooler (21) on an auxiliary device mounting base (22); and an oil gallery (24) provided inside an air-intake-side wall of the cylinder block (5). The lubricating apparatus causes, using the pump pressure of the oil pump, an engine oil (4*a*) inside the oil pan (4) to circulate sequentially through the oil pump, the oil cooler (21), the oil filter (23), the oil gallery (24), an engine sliding part including a bearing (8*a*) of the crankshaft (8) shown in FIG. 3, and the oil pan (4), to forcibly lubricate the sliding part of the engine.

As shown in FIG. 3, the oil-cooling apparatus includes: an oil jet delivery passage (25) provided in parallel to the oil gallery (24) inside the air-intake-side wall of the cylinder block (5); an oil jet nozzle (25*a*) provided below a piston (26); and a cooling channel (26*a*) provided inside the piston (26). Part of the engine oil (4*a*) sequentially passing through the oil cooler (21) and the oil filter (23) of the lubricating apparatus is branched into the oil jet delivery passage (25) inside the auxiliary device mounting base (22) and injected into the cooling channel (26*a*) from the oil jet nozzle (25*a*), to cool the piston (26).

The water-cooling apparatus is structured as follows.

As shown in FIG. 1A, the water-cooling apparatus includes the cylinder head (6). The cylinder head (6) includes an air intake port (2), an exhaust port (3), and the head water jacket (20) that allows an engine cooling water (36) to pass around the ports (2), (3).

Accordingly, the water-cooling apparatus is advantageous in its being capable of strongly cooling the cylinder head (6) with the engine cooling water (36).

As shown in FIG. 1A, when the extending direction of the crankshaft (8) is the front-rear direction and the width direction of the cylinder head (6) perpendicular to the front-rear direction is the lateral direction, the laterally one end of the cylinder head (6) is an exhaust end (6*a*), and the laterally other end thereof is an air intake end (6*b*).

The exhaust port (3) includes: a first exhaust valve opening (3*a*); and a second exhaust valve opening (3*b*) provided on the exhaust end (6*a*) side relative to the first exhaust valve opening (3*a*). An exhaust port wall includes: a first exhaust entrance port wall (3*d*) on the first exhaust valve opening (3*a*) side; and a second exhaust entrance port wall (3*e*) on the second exhaust valve opening (3*b*) side.

The head water jacket (20) includes an inter-exhaust-port-wall water channel (29) between the first exhaust entrance port wall (3*d*) and the second exhaust entrance port wall (3*e*).

The cylinder head (6) includes a cooling water injection passage (27) provided at a bottom wall (6*c*) of the cylinder head (6). The cooling water injection passage (27) is positioned (biased) on the exhaust end (6*a*) side, and includes a passage entrance (27*a*) provided on the exhaust end (6*a*) side, and a passage exit (27*b*) directed toward the inter-exhaust-port-wall water channel (29).

The exhaust port wall includes a heat dissipation fin (28) extending from the first exhaust entrance port wall (3*d*) toward the exhaust end (6*a*). The space between the heat dissipation fin (28) and the second exhaust entrance port wall (3*e*) forms a water channel entrance (29*a*) of the inter-exhaust-port-wall water channel (29).

Into the passage entrance (27*a*) of the cooling water injection passage (27), the engine cooling water (36) rising from the exhaust side of the block water jacket (19) is drawn.

Accordingly, in the present embodiment, as shown in FIG. 1A, the bottom wall (6*c*) of the cylinder head (6) on the exhaust end (6*a*) side with great heat load is strongly cooled by the engine cooling water (36) passing through the cooling water injection passage (27). Further, the first exhaust entrance port wall (3*d*) and the second exhaust entrance port wall (3*e*) with great heat load are strongly cooled by the engine cooling water (36) injected from the cooling water injection passage (27). These factors improve cooling on the exhaust side, and minimize thermal strain of the cylinder head (6).

Further, by virtue of heat dissipation of the heat dissipation fin (28), high heat dissipation performance is achieved at the first exhaust entrance port wall (3*d*).

Still further, as shown in FIG. 1A, by virtue of the heat dissipation fin (28), the engine cooling water (36) is prevented from diffusing into the direction distancing from the inter-exhaust-port-wall water channel (29), and instead smoothly flows into the inter-exhaust-port-wall water channel (29). Thus, high cooling performance is achieved at the first exhaust entrance port wall (3*d*) and the second exhaust entrance port wall (3*e*).

Note that, by the engine cooling water (36) being injected from the cooling water injection passage (27), the engine cooling water (36) near the water channel entrance (29*a*) of the inter-exhaust-port-wall water channel (29) is drawn into the water channel entrance (29*a*). Into the water channel entrance (29*a*), the engine cooling water (36) rising from an inter-cylinder-bore water channel of the block water jacket (19) via a rising hole (39) is also drawn.

As shown in FIG. 1A, a water channel exit (29*b*) of the inter-exhaust-port-wall water channel (29) is directed to the fuel injector (15).

Accordingly, in the present embodiment, as shown in FIG. 1A, by virtue of the engine cooling water (36) having passed through the inter-exhaust-port-wall water channel (29) being directed to the fuel injector (15), high cooling performance is achieved at the fuel injector (15).

As shown in FIG. 1A, an air intake port wall includes an intake air exit port wall (2*b*) provided on an intake valve opening (2*a*) side. The head water jacket (20) includes an inter-intake/exhaust-port-wall water channel (30) between the intake air exit port wall (2*b*) and the second exhaust entrance port wall (3*e*).

The cylinder head (6) includes a second cooling water injection passage (31) provided at the bottom wall (6*c*) of the head water jacket (20). The second cooling water injection passage (31) includes a second passage entrance (31*a*) provided on the exhaust end (6*a*) side, and a second passage exit (31*b*) directed to a water channel entrance (30*a*) of the inter-intake/exhaust-port-wall water channel (30).

Accordingly, in the present embodiment, as shown in FIG. 1A, the second exhaust entrance port wall (3*e*) with great heat load is strongly cooled by the engine cooling water (36) injected from the second cooling water injection passage (31). This reduces the temperature difference between the second exhaust entrance port wall (3*e*) and the intake air exit port wall (2*b*) with small heat load, and minimizes thermal strain of the cylinder head (6).

Into the second passage entrance (31*a*) of the second cooling water injection passage (31), the engine cooling water (36) rising from the exhaust side of the block water jacket (19) is drawn.

As shown in FIG. 1A, the second cooling water injection passage (31) is positioned (biased) on the exhaust end (6*a*) side.

Accordingly, in the present embodiment, as shown in FIG. 1A, the bottom wall (6*c*) of the cylinder head (6) on the exhaust end (6*a*) side with great heat load is strongly cooled by the engine cooling water (36) passing through the second cooling water injection passage (31). This improves cooling on the exhaust side, and minimizes thermal strain of the cylinder head (6).

As shown in FIGS. 1A and 1C, the cylinder head (6) includes a second heat dissipation fin (32) along a lower surface (6*f*) of a ceiling wall (6*d*) of the cylinder head (6).

Between the second heat dissipation fin (32) and the bottom wall (6*c*) of the cylinder head (6), a constricted passage (32*a*) is provided. The constricted passage (32*a*) is disposed upstream in a flow direction in the inter-intake/exhaust-port-wall water channel (30).

Accordingly, in the present embodiment, as shown in FIGS. 1A and 1C, the engine cooling water (36) flowing toward the water channel entrance of the inter-intake/exhaust-port-wall water channel (30) is deflected toward the bottom wall (6*c*) of the cylinder head (6) with the second heat dissipation fin (32), and the side of the second exhaust entrance port wall (3*e*) near the second exhaust valve opening (3*b*) with great heat load is strongly cooled. Thus, high cooling performance is achieved at the second exhaust entrance port wall (3*e*).

As shown in FIGS. 1A and 1C, the cylinder head (6) includes a push rod chamber wall (6*e*) provided on the exhaust end (6*a*) side at a position opposing to an intake valve shaft insertion boss (2*c*). The second heat dissipation fin (32) is provided to extend between the intake valve shaft insertion boss (2*c*) and the push rod chamber wall (6*e*).

Accordingly, in the present embodiment, as shown in FIGS. 1A and 1C, the heat of the push rod chamber wall (6*e*) provided on the exhaust end (6*a*) side is dissipated into the intake valve shaft insertion boss (2*c*) via the second heat dissipation fin (32). This reduces the temperature difference between the exhaust side and the air intake side of the cylinder head (6), and minimizes thermal strain of the cylinder head (6).

As shown in FIG. 1A, the second heat dissipation fin (32) is positioned farther from the inter-intake/exhaust-port-wall water channel (30) than the second passage exit (31*b*) of the second cooling water injection passage (31) is.

Accordingly, in the present embodiment, as shown in FIG. 1A, the backflow of the engine cooling water (36) injected from the second passage exit (31*b*) of the second cooling water injection passage (31) and having its temperature increased by absorbing the heat at the water channel entrance (30*a*) of the inter-intake/exhaust-port-wall water channel (30) thereby rising is received by the second heat dissipation fin (32). This reduces a reduction in the amount of the engine cooling water (36) passing through the inter-intake/exhaust-port-wall water channel (30), achieving high cooling performance at the second exhaust entrance port wall (3*e*).

As shown in FIG. 1A, a water channel exit (30*b*) of the inter-intake/exhaust-port-wall water channel (30) is directed to the fuel injector (15).

Accordingly, in the present embodiment, as shown in FIG. 1A, the engine cooling water (36) flowing out from the inter-intake/exhaust-port-wall water channel (30) is directed to the fuel injector (15), whereby high cooling performance is achieved at the fuel injector (15).

Figure 2:
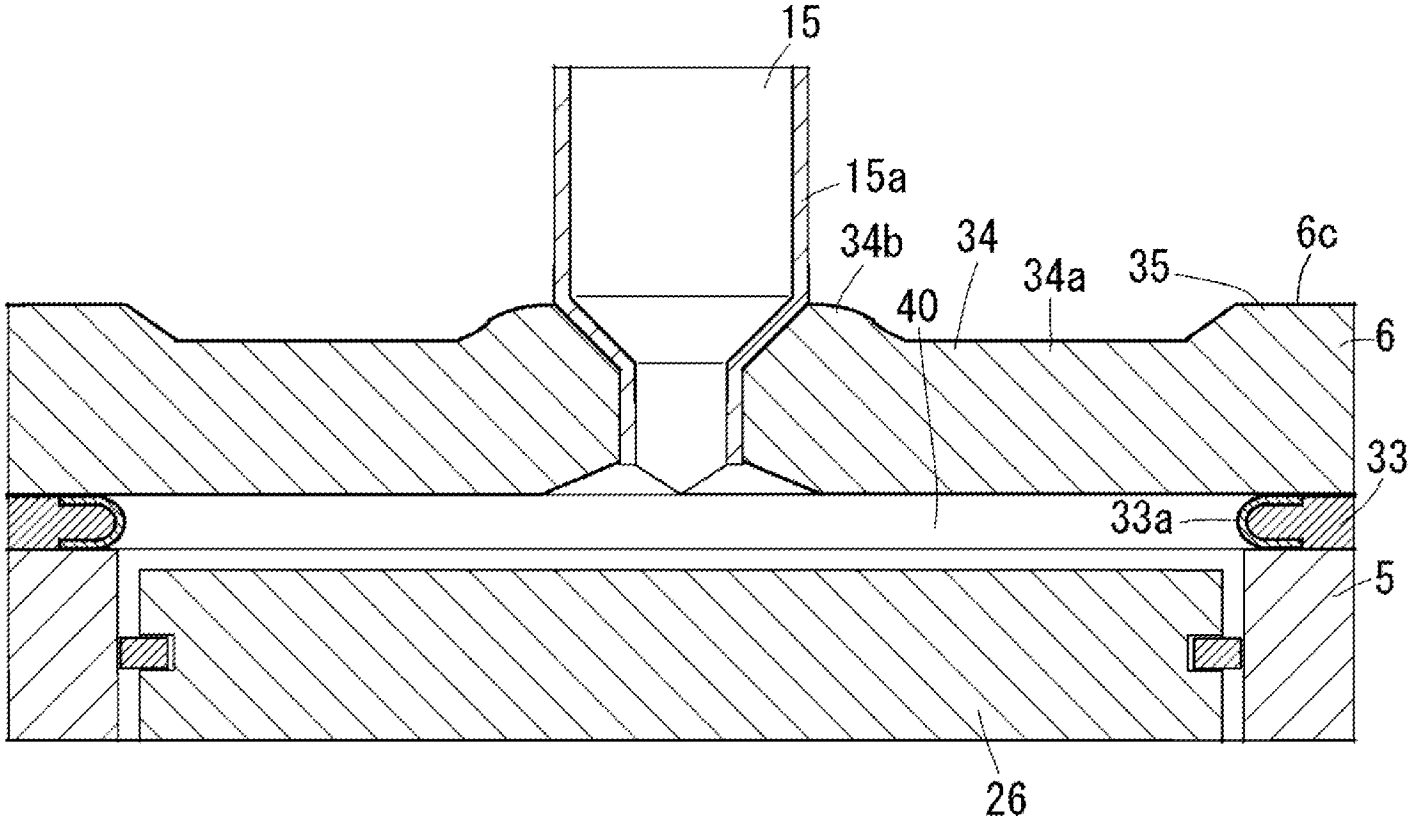
FIG. 2 is a vertical cross-sectional view of a combustion chamber of a water cooled engine according to the embodiment of the present invention.

As shown in FIG. 2, a head gasket (33) interposed between the cylinder block (5) and the cylinder head (6) is further provided.

The bottom wall (6*c*) of the cylinder head (6) includes a combustion chamber ceiling wall (34) and a pushing wall (35) positioned on the outer circumference side of the combustion chamber ceiling wall (34) and pushing a bead (33*a*) of the head gasket (33).

In the bottom wall (6*c*) of the cylinder head (6), the pushing wall (35) is greater in thickness than an outer peripheral part (34*a*) of the combustion chamber ceiling wall (34) being adjacent to the pushing wall (35).

Accordingly, in the present embodiment, as shown in FIG. 2, by virtue of the outer peripheral part (34*a*) of the combustion chamber ceiling wall (34) with great heat load being smaller in thickness, heat is less prone to accumulate and, consequently, displacement of the pushing wall (35) toward the radially outward direction of the cylinder due to thermal expansion of the combustion chamber ceiling wall (34) is less prone to occur. Further, by virtue of the pushing wall (35) pushing the bead (33*a*) being greater in thickness, any depression due to reaction force of the bead (33*a*) little occurs. Thus, high sealing performance is achieved at the head gasket (33).

FIG. 2 further shows an injector cover (15*a*), an injector insertion boss (34*b*), and the combustion chamber (40).

FIG. 1 further shows a second intake valve opening (37) provided on the air intake end (6*b*) side than the intake valve opening (2*a*) is, and a second intake air exit port wall (37*a*). The intake valve opening (2*a*) belongs to a helical air intake port, and the second intake valve opening (37) belongs to a tangential air intake port. FIG. 1 further shows an inter-intake-port-wall channel (38) between the intake air exit port wall (2*b*) and the second intake air exit port wall (37*a*).

What is claimed is:

1. A water cooled engine comprising a cylinder head, the cylinder head including an air intake port, an exhaust port, and a head water jacket that allows an engine cooling water to pass around the ports, wherein when an extending direction of a crankshaft is a front-rear direction and a width direction of the cylinder head being perpendicular to the front-rear direction is a lateral direction, a laterally one end of the cylinder head is an exhaust end and a laterally other end of the cylinder head is an air intake end, the cylinder head includes a cooling water injection passage provided at a bottom wall of the cylinder head, the cooling water injection passage being positioned on the exhaust end side, and is configured to inject the engine cooling water into the head water jacket, the cylinder head includes an intake valve shaft insertion boss, a push rod chamber wall provided on the exhaust end side at a position opposing to the intake valve shaft insertion boss, and an extending heat dissipation fin extending from the push rod chamber wall to the intake valve shaft insertion boss.

2. The water cooled engine according to claim 1, wherein an air intake port wall of the air intake port includes an intake air exit port wall provided on an intake valve opening side, an exhaust port wall of the exhaust port includes an exhaust entrance port wall, and the head water jacket includes an inter-intake/exhaust-port-wall water channel between the intake air exit port wall and the exhaust entrance port wall, the cylinder head includes a second cooling water injection passage provided at the bottom wall of the head water jacket, the second cooling water injection passage including a second passage entrance provided on the exhaust end side and a second passage exit directed to a water channel entrance of the inter-intake/exhaust-port-wall water channel, the extending heat dissipation fin extends along a lower surface of a ceiling wall of the cylinder head, and between the extending heat dissipation fin and the bottom wall of the cylinder head a constricted passage is provided, the constricted passage being disposed on a side of the second passage exit of the second cooling water injection passage which is upstream in a flow direction of the inter-intake/exhaust-port-wall water channel, and the second passage exit is directed to the water channel entrance of the inter-intake/exhaust-port-wall water channel in a direction crossing the extending heat dissipation fin, when viewed from a side of the ceiling wall of the cylinder head.

3. The water cooled engine according to claim 2, wherein the extending heat dissipation fin is positioned farther from the inter-intake/exhaust-port-wall water channel than the second passage exit of the second cooling water injection passage is.

4. The water cooled engine according to claim 1, wherein the exhaust port includes a first exhaust valve opening and a second exhaust valve opening provided on the exhaust end side relative to the first exhaust valve opening, an exhaust port wall of the exhaust port including a first exhaust entrance port wall on the first exhaust valve opening side and a second exhaust entrance port wall on the second exhaust valve opening side, the head water jacket includes an inter-exhaust-port-wall water channel between the first exhaust entrance port wall and the second exhaust entrance port wall, the cooling water injection passage includes a passage entrance provided on the exhaust end side and a passage exit directed toward the inter-exhaust-port-wall water channel, the exhaust port wall includes a leading heat dissipation fin extending from the first exhaust entrance port wall toward the exhaust end, a space between the leading heat dissipation fin and the second exhaust entrance port wall forming a water channel entrance of the inter-exhaust-port-wall water channel, and when viewed in a direction orthogonal to the bottom wall of the cylinder head, the leading heat dissipation fin is curved so that a side of the water channel entrance of the inter-exhaust-port-wall water channel is recessed.

5. The water cooled engine according to claim 4, wherein a water channel exit of the inter-exhaust-port-wall water channel is directed to a fuel injector.

6. The water cooled engine according to claim 4, wherein an air intake port wall of the air intake port includes an intake air exit port wall provided on an intake valve opening side, and the head water jacket includes an inter-intake/exhaust-port-wall water channel between the intake air exit port wall and the second exhaust entrance port wall, and the cylinder head includes a second cooling water injection passage provided at the bottom wall of the head water jacket, the second cooling water injection passage including a second passage entrance provided on the exhaust end side and a second passage exit directed to a water channel entrance of the inter-intake/exhaust-port-wall water channel.

7. The water cooled engine according to claim 2, wherein the second cooling water injection passage is positioned on the exhaust end side.

8. The water cooled engine according to claim 3, wherein the second cooling water injection passage is positioned on the exhaust end side.

9. The water cooled engine according to claim 6, wherein the second cooling water injection passage is positioned on the exhaust end side.

10. The water cooled engine according to claim 6, wherein the extending heat dissipation fin extends along a lower surface of a ceiling wall of the cylinder head, and between the extending heat dissipation fin and the bottom wall of the cylinder head, a constricted passage is provided, the constricted passage being disposed on a side of the second passage exit of the second cooling water injection passage which is upstream in a flow direction in the inter-intake/exhaust-port-wall water channel, and the second passage exit is directed to the water channel entrance of the inter-intake/exhaust-port-wall water channel in a direction crossing the extending heat dissipation fin, when viewed from a side of the ceiling wall of the cylinder head.

11. The water cooled engine according to claim 9, wherein the extending heat dissipation fin extends along a lower surface of a ceiling wall of the cylinder head, and between the extending heat dissipation fin and the bottom wall of the cylinder head, a constricted passage is provided, the constricted passage being disposed on a side of the second passage exit of the second cooling water injection passage which is upstream in a flow direction in the inter-intake/exhaust-port-wall water channel, and the second passage exit is directed to the water channel entrance of the inter-intake/exhaust-port-wall water channel in a direction crossing the extending heat dissipation fin, when viewed from a side of the ceiling wall of the cylinder head.

12. The water cooled engine according to claim 10, wherein the extending heat dissipation fin is positioned farther from the inter-intake/exhaust-port-wall water channel than the second passage exit of the second cooling water injection passage is.

13. The water cooled engine according to claim 11, wherein the extending heat dissipation fin is positioned farther from the inter-intake/exhaust-port-wall water channel than the second passage exit of the second cooling water injection passage is.

14. The water cooled engine according to claim 2, wherein a water channel exit of the inter-intake/exhaust-port-wall water channel is directed to a fuel injector.

15. The water cooled engine according to claim 1, further comprising a head gasket interposed between the cylinder block and the cylinder head, wherein the bottom wall of the cylinder head includes a combustion chamber ceiling wall and a pushing wall positioned on an outer circumferential side of the combustion chamber ceiling wall and pushing a bead of the head gasket, and in the bottom wall of the cylinder head, the pushing wall is greater in thickness than an outer peripheral part of the combustion chamber ceiling wall being adjacent to the pushing wall.

* * * * *